US010247462B2

(12) United States Patent
Lee

(10) Patent No.: US 10,247,462 B2
(45) Date of Patent: Apr. 2, 2019

(54) ICE-MAKING DEVICE FOR REFRIGERATOR AND REFRIGERATOR INCLUDING THE SAME

(71) Applicant: Dongbu Daewoo Electronics Corporation, Seoul (KR)

(72) Inventor: Jang Woo Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/481,190

(22) Filed: Apr. 6, 2017

(65) Prior Publication Data

US 2017/0307273 A1 Oct. 26, 2017

(30) Foreign Application Priority Data

Apr. 22, 2016 (KR) ..... 10-2016-0049634

(51) Int. Cl.

| | |
|---|---|
| ***F25C 1/24*** | (2018.01) |
| ***F25C 5/08*** | (2006.01) |
| ***F25C 5/00*** | (2018.01) |
| ***F25C 5/18*** | (2018.01) |
| ***F25C 5/182*** | (2018.01) |
| ***F25C 1/04*** | (2018.01) |
| ***F25C 5/20*** | (2018.01) |
| *F25C 5/185* | (2018.01) |

(Continued)

(52) U.S. Cl.

CPC ..... *F25C 5/182* (2013.01); *F25C 1/04* (2013.01); *F25C 1/24* (2013.01); *F25C 5/22* (2018.01); *F25C 5/08* (2013.01); *F25C 5/185* (2013.01); *F25C 2400/10* (2013.01); *F25D 11/025* (2013.01); *F25D 17/065* (2013.01); *F25D 2317/061* (2013.01); *F25D 2317/0682* (2013.01)

(58) Field of Classification Search

CPC .... F25C 5/005; F25C 5/22; F25C 1/24; F25C 5/182; F25C 1/04; F25C 5/08; F25D 11/025; F25D 17/065; F25D 2317/061

See application file for complete search history.

(56) References Cited

U.S. PATENT DOCUMENTS

| | | | |
|---|---|---|---|
| 2,026,227 | A | 12/1935 | Foraker |
| 2,478,312 | A | 8/1949 | Peltier |
| 2,717,497 | A | 9/1955 | Knerr |

(Continued)

FOREIGN PATENT DOCUMENTS

| | | | |
|---|---|---|---|
| EP | 0851191 | A1 | 7/1998 |
| EP | 1790922 | A1 | 5/2007 |

(Continued)

OTHER PUBLICATIONS

Extended European Search Report dated Jul. 26, 2017 issued in corresponding European Patent Application No. 17165985.7.

*Primary Examiner* — Kun Kai Ma

(57) ABSTRACT

A refrigerator having an ice-making device evaporator in addition to a refrigerator storage room evaporator. The ice-making device includes an ice tray and a cooling pipe contacting an outer surface of the ice tray. A refrigerant flows in the cooling pipe and directly cools the ice tray. The ice-making device evaporator receives the refrigerant from a condenser and supplies it to the cooling pipe. A heat insulation member wraps around the cooling pipe and can prevent the cooling pipe from exchanging heat with ambient air.

9 Claims, 6 Drawing Sheets

(51) Int. Cl.
*F25D 11/02* (2006.01)
*F25D 17/06* (2006.01)

(56) References Cited

U.S. PATENT DOCUMENTS

| | | | | |
|---|---|---|---|---|
| 2,717,499 | A | 9/1955 | Ashby et al. | |
| 2,717,504 | A | 9/1955 | Knerr | |
| 2,778,198 | A | 1/1957 | Heath | |
| 2,796,741 | A | 6/1957 | Barton | |
| 2,844,008 | A | 7/1958 | Barton | |
| 3,144,078 | A * | 8/1964 | Morton | F25C 1/04 165/263 |
| 3,788,089 | A * | 1/1974 | Graves | F25C 1/04 165/135 |
| 4,872,317 | A | 10/1989 | Reed | |
| 9,689,600 | B2 * | 6/2017 | Jeong | F25C 1/04 |
| 2011/0000248 | A1 * | 1/2011 | Jeong | F25C 1/04 62/344 |
| 2011/0162392 | A1 * | 7/2011 | Lim | F25D 29/00 62/66 |
| 2011/0162406 | A1 * | 7/2011 | Shin | F25C 1/24 62/351 |
| 2012/0047917 | A1 * | 3/2012 | Rafalovich | F25D 11/025 62/66 |
| 2012/0090346 | A1 * | 4/2012 | Mitchell | F25C 5/22 62/340 |
| 2012/0279240 | A1 * | 11/2012 | Jeong | F25C 1/04 62/129 |
| 2012/0304676 | A1 * | 12/2012 | White | F25C 1/04 62/157 |
| 2013/0167575 | A1 * | 7/2013 | Hong | F25C 1/00 62/344 |
| 2013/0227983 | A1 * | 9/2013 | Jeong | F25D 23/061 62/285 |
| 2016/0245574 | A1 * | 8/2016 | Jeong | F25C 1/24 |
| 2016/0252286 | A1 * | 9/2016 | Jeong | F25C 1/18 62/130 |

FOREIGN PATENT DOCUMENTS

| | | | |
|---|---|---|---|
| FR | 1066201 | A | 6/1954 |
| FR | 2193186 | A1 | 2/1974 |
| FR | 2893706 | A1 | 5/2007 |
| KR | 10-2007-0120765 | A | 12/2007 |
| KR | 10-2009-0012687 | A | 2/2009 |
| KR | 10-2011-0080104 | A | 7/2011 |
| KR | 10-2013-0101371 | A | 9/2013 |
| WO | 2009/017286 | A1 | 2/2009 |

* cited by examiner

ICE-MAKING DEVICE FOR REFRIGERATOR AND REFRIGERATOR INCLUDING THE SAME

CROSS-REFERENCE TO RELATED APPLICATIONS

This application is based on and claims priority from Korean Patent Application No. 10-2016-0049634, filed on Apr. 22, 2016, the disclosure of which is incorporated herein in its entirety by reference for all purposes.

TECHNICAL FIELD

Embodiments of the present disclosure relate to refrigerators, and more particularly, to ice making and dispensing mechanisms in refrigerators.

BACKGROUND

A refrigerator is an appliance used for storing food or other times at low temperature, e.g., in a frozen state or refrigerated. The interior of the refrigerator is cooled by cold air circulating therein.

The refrigerator includes a heat exchanger configured to supply cold air into the refrigerator. Cold air can be continuously generated as a refrigerant recycling through compression, condensation, expansion and evaporation. Cold air supplied in the refrigerator is uniformly distributed by convection.

The heat exchanger may be installed at a side of the refrigerator and isolated from the storage spaces such as the refrigeration compartment and the freezer. For example, compression and condensation processes may be performed by a compressor and a condenser disposed within a machine compartment located at the lower back side of the refrigerator. By evaporation of a refrigerant, the refrigerant may absorb heat from ambient air surrounding the evaporator and thereby produce cool air.

The refrigerator includes a main body having a rectangular parallelepiped shape with a front opening. A refrigeration compartment and a freezer may be disposed in the main body. A refrigeration compartment door and a freezer door may cover the front of the main body. Drawers, racks, storage boxes and the like for sorting and storing different kinds of items may be disposed in the internal storage space of the refrigerator.

In general, a top-mount-type refrigerator has a freezer located on top of a refrigeration compartment. In contrast, a bottom-freezer-type refrigerator has a freezer located under the refrigeration compartment. This enables a user to conveniently access the refrigeration compartment. On the other hand, this may be inconvenient for a user to access the freezer, if the user has to bend or lower his or her body to reach, e.g., to take out ice pieces.

Some bottom-freezer-type refrigerators have an ice dispenser disposed in a refrigeration compartment door located at the upper side of the refrigerator. In this case, an ice-making device for supplying ice may be disposed in the refrigeration compartment door or the interior of the refrigeration compartment.

Ice-making devices may be classified into indirectly-cooled ice-making devices (which use cold air to freeze water into ice), and directly-cooled ice-making devices (which rely on heat transfer between a refrigerant pipe and an ice tray to freeze water). The directly-cooled ice-making devices have much higher cooling efficiency.

However, in a directly-cooled ice-making device, frost often undesirably forms on the refrigerant pipe and the ice tray. The frost can impair the performance and efficiency of the ice-making device.

SUMMARY

Embodiments of the present disclosure provide an ice-making device capable of reducing or preventing frost formation on the components thereof.

According to embodiments of the present disclosure, an ice-making device for a refrigerator includes an ice tray; a cooling pipe contacting an outer surface of the ice tray, the cooling pipe configured to directly cool the ice tray; and a heat insulation member configured to surround the cooling pipe and to prevent the cooling pipe from exchanging heat with ambient air.

Further, the ice-making device includes a heater unit disposed around the ice tray and configured to heat the ice tray. A heat insulation member surrounds the heater unit and prevents the heater unit from exchanging heat with ambient air. The device includes an ice storage part configured to store the ice pieces.

The ice-making device includes an ice-making device evaporator configured to cool the ice storage part. The ice-making device evaporator is a separate unit from a refrigerator room evaporator used for generating cold air for circulation in a refrigerator storage room.

The ice storage part has a discharge path for discharging water condensation from the ice storage part.

The ice-making device evaporator is configured to receive a refrigerant from a condenser in the refrigerator. The refrigerant is delivered to the cooling pipe after cooling the ice storage part.

Further, the device includes a fan configured to blow air cooled in the ice-making device evaporator.

DETAILED DESCRIPTION

Figure 1:
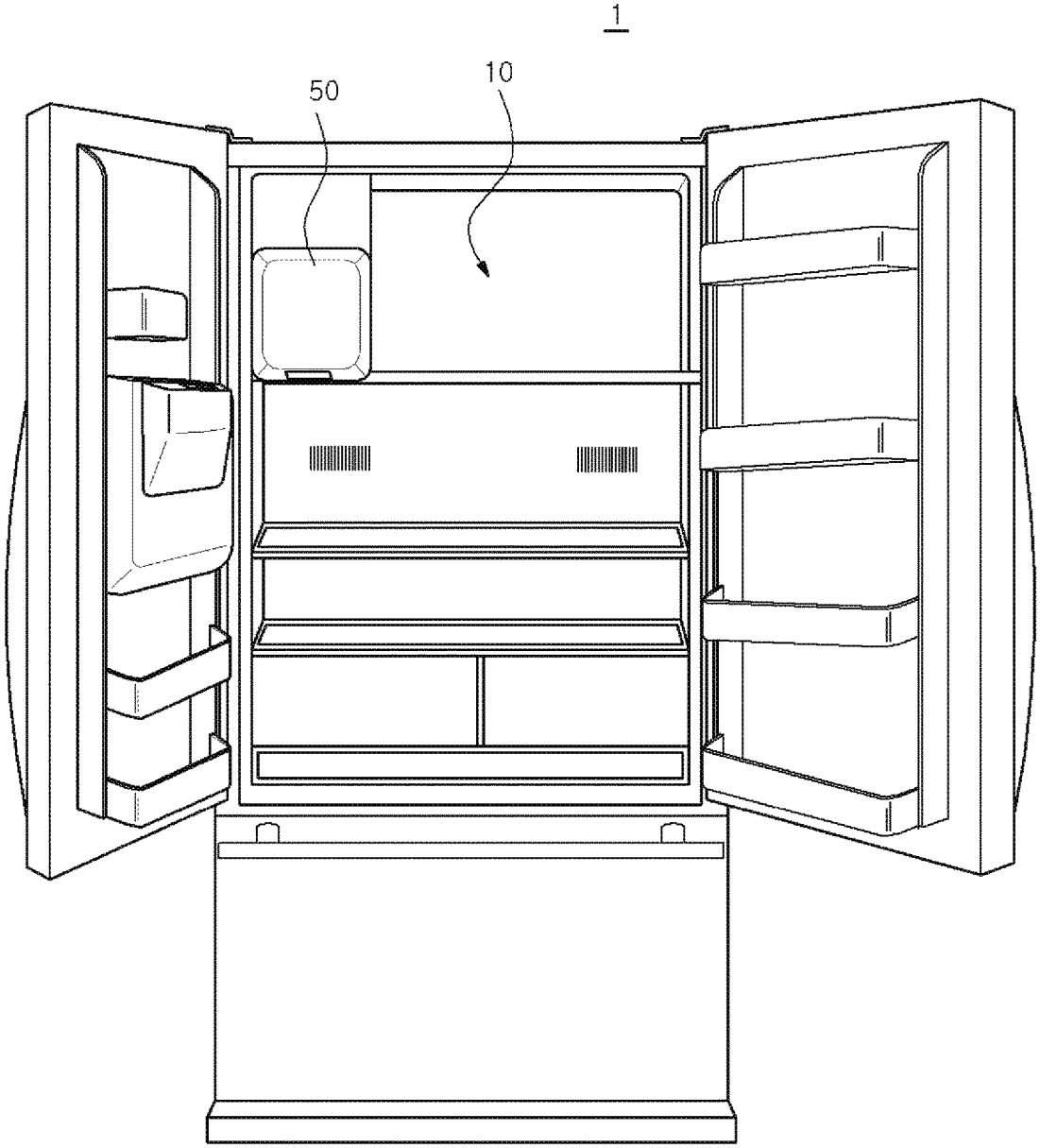
FIG. 1 is a perspective view illustrating the configuration of an exemplary refrigerator provided with an ice-making device according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, may include a modification of form due to manufacturing.

The configurations of an exemplary ice-making device and the associated exemplary refrigerator is described with reference to FIGS. 1 to 6.

Figure 2:
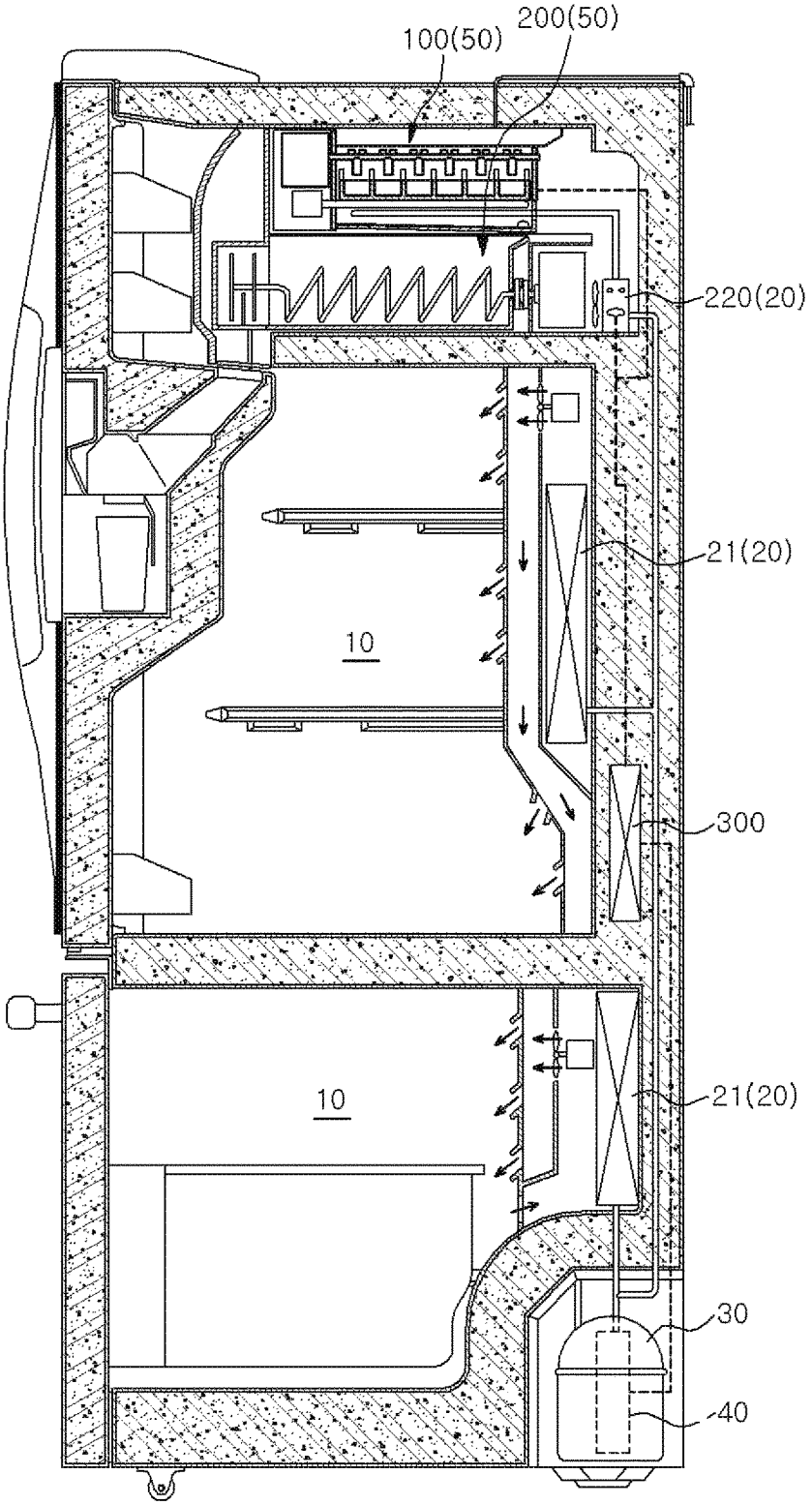
FIG. 2 is a side view of the refrigerator illustrated in FIG. 1.
Figure 3:
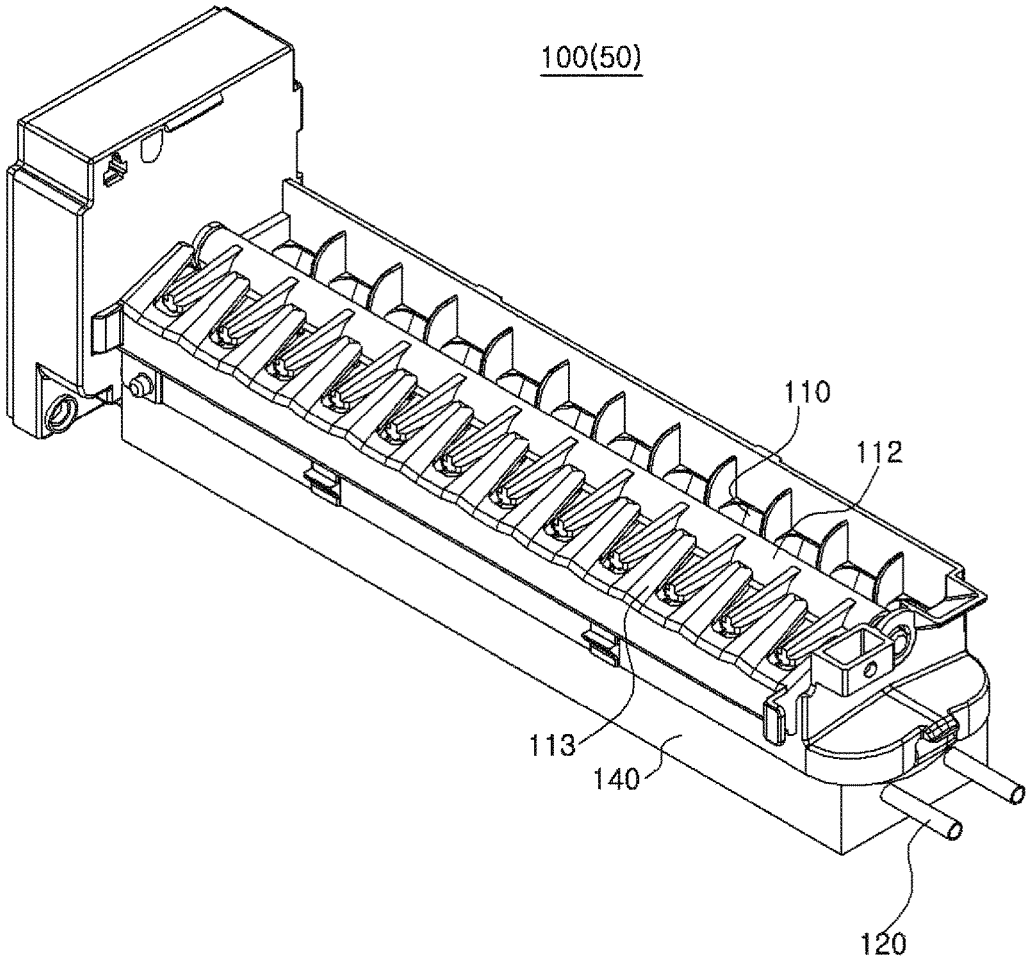
FIG. 3 is a view illustrating the configuration of the exemplary ice-making device for a refrigerator illustrated in FIG. 1.
Figure 4:
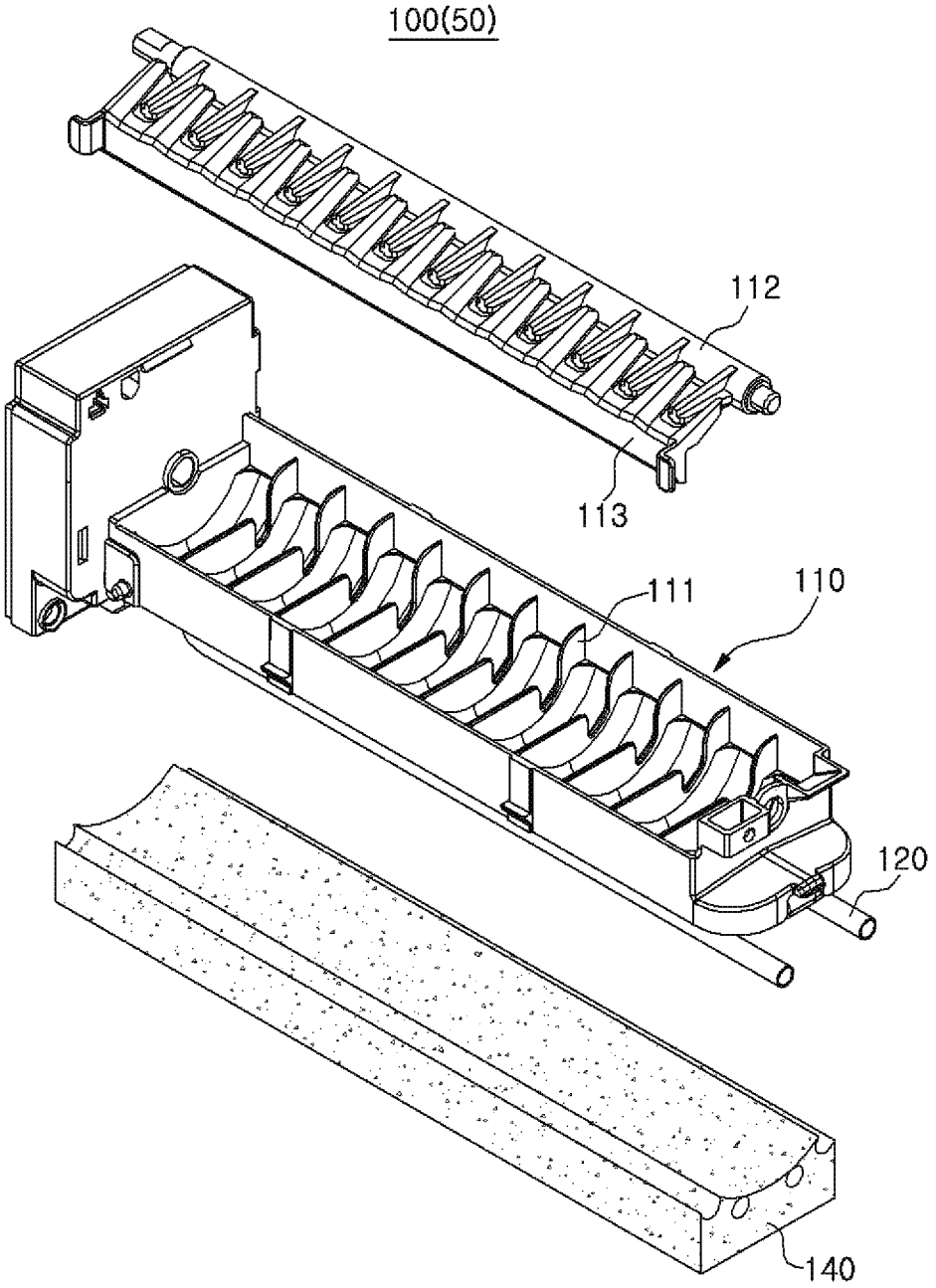
FIG. 4 is an exploded perspective view of the exemplary ice-making device illustrated in FIG. 3.
Figure 5:
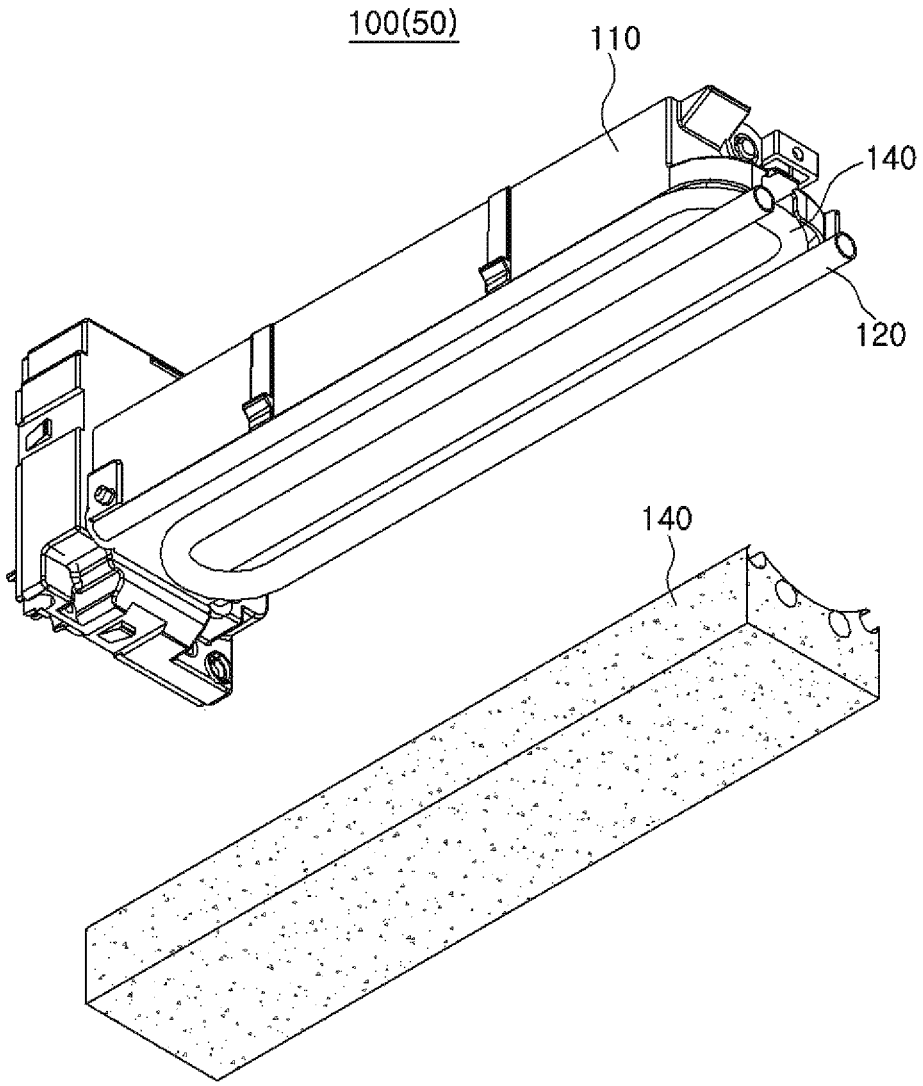
FIG. 5 is an exploded bottom perspective view of the exemplary ice-making device illustrated in FIG. 3.
Figure 6:
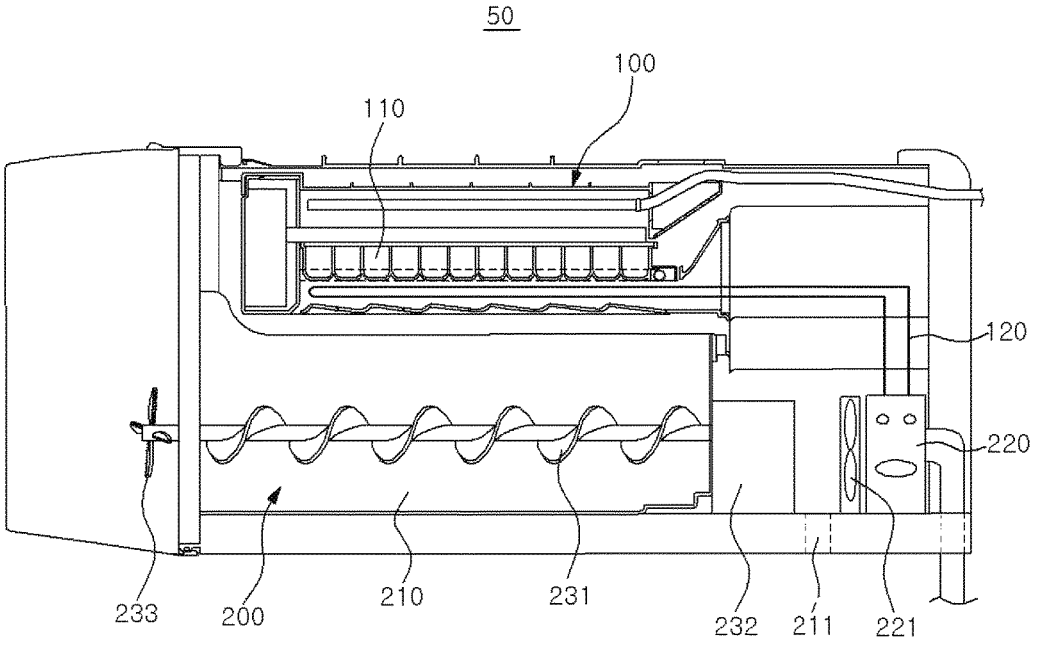
FIG. 6 is a side view of the exemplary ice-making device illustrated in FIG. 3.

FIG. 1 is a perspective view illustrating the configuration of an exemplary refrigerator provided with an ice-making device according to one embodiment of the present disclosure. FIG. 2 is a side view of the refrigerator illustrated in FIG. 1. FIG. 3 is a view illustrating the configuration of the exemplary ice-making device for a refrigerator illustrated in FIG. 1. FIG. 4 is an exploded perspective view of the exemplary ice-making device illustrated in FIG. 3. FIG. 5 is an exploded bottom perspective view of the exemplary ice-making device illustrated in FIG. 3. FIG. 6 is a side view of the exemplary ice-making device illustrated in FIG. 3.

Referring to FIGS. 1 to 6, the refrigerator 1 according to one embodiment of the present disclosure may include a refrigerator room 10, an evaporator 20, a compressor 30, a condenser 40 and an ice-making device 50 for a refrigerator.

Cold air is generated through repeated cycles of compression, condensation, expansion and evaporation of a refrigerant. More specifically, a gaseous refrigerant having low temperature and low pressure is compressed by a compressor 30 into a gaseous state having high temperature and high pressure. The gaseous refrigerant having high temperature and high pressure is condensed by a condenser 30 into a liquid state having high temperature and high pressure. In an expander (not shown), the liquid refrigerant having high temperature and high pressure is expanded into a liquid refrigerant having low temperature and low pressure. Then, the liquid refrigerant having low temperature and low pressure is fed to an evaporator 20. In the evaporator 20, the liquid refrigerant having low temperature and low pressure is evaporated by absorbing heat from ambient air, thereby converting ambient air into cold air for supply to the storage spaces. Evaporated refrigerant is introduced into the compressor 40 again. Cold air around the evaporator 20 is supplied into the refrigerator room 10, thereby cooling the refrigerator room 10.

The evaporator 20 may supply a refrigerant to the ice-making device 50. The refrigerator 1 may include a plurality of evaporators 20, including a refrigerator room evaporator 21 configured to supply cold air into the refrigerator room 10, and an ice-making device evaporator 220 configured to supply a refrigerant to the ice-making device 50.

The ice-making device 50 may include an ice-making unit 100 and an ice-storing unit 200.

The ice-making unit 100 may include an ice tray 110, a cooling pipe 120, a heater unit 130 and a heat insulation member 140.

The ice tray 110 is configured to receive water. The water in the ice tray 110 can freeze into ice pieces by cold air. The ice tray 110 may include partition walls 111 configured to divide separate ice pieces, an ice-releasing member 112 configured to discharge ice pieces from the ice tray 110, and an ice-releasing member guide 113 configured to guide the ice-releasing member 112. The partition walls 111 may have various shapes and number in different embodiments. The ice-releasing member 112 may be rotatable and driven by a drive device, such as a motor or the like.

The ice tray 110 may include a heat transfer member. The heat transfer member may effectively transfer cold air received from the cooling pipe 120 to the water. The heat transfer member may be disposed outside the ice tray 110 and have the same shape as the ice tray 110. However, the present disclosure is not necessarily limited thereto.

The cooling pipe 120 may cool the ice tray 110. Furthermore, water in the ice tray 110 may freeze into ice pieces through heat exchange with the cooling pipe 120. A refrigerant may flow through the cooling pipe 120. The refrigerant in the cooling pipe 120 may be at least a part of the refrigerant supplied from the condenser 40 to the ice-making device evaporator 220. However, in some other embodiments, the refrigerant in the cooling pipe 120 may be from a different supply rather than the condenser 40. In this case, the refrigerant flowing through the cooling pipe 120 may be cooled by the ice-making device evaporator 220. For this purpose, a refrigerant flow path of the condenser 40 may be disposed within a refrigerant flow path of the cooling pipe 120, or vice versa. An opening/closing device such as a valve or the like and a pressurizing device such as a pump or the like may be used to regulate the refrigerant flow through the cooling pipe 120. The opening/closing device and the pressurizing device may be controlled by a control unit 300.

The cooling pipe 120 may be disposed outside and around the ice tray 110. For example, the cooling pipe 120 may directly contact the outer surface of the ice tray 110 with no gap between the cooling pipe 120 and the ice tray 110. This enables the cooling pipe 120 to efficiently absorb the heat of the ice tray 110.

The heater unit 130 is configured to heat the ice tray 110. Ice pieces in the ice tray 110 may be melted partially by the heater unit 130 for purposes of releasing ice pieces from the ice tray 110. The heater unit 130 may be disposed around the ice tray 110. For example, the heater unit 130 may directly contact the ice tray 110. The heater unit 130 may include a pipe through which a heat medium flows. However, the present disclosure is not necessarily limited thereto. For example, the heater unit 130 may include an electric wire that generates heat from electric energy.

The heat insulation member 140 may surround the cooling pipe 120. In other words, a portion of the cooling pipe 120 may be surrounded by the heat insulation member 140 and another portion of the cooling pipe 120 may be surrounded by the ice tray 110. Furthermore, the heat insulation member 140 may be configured to surround at least a portion of the ice tray 110. The heat insulation member 140 may prevent the cooling pipe 120 and the ice tray 110 form exchanging heat with the ambient air having a relatively high temperature. Thus, the heat insulation member 140 may reduce or prevent generation of frost on the surface of the cooling pipe 120 and on the surface of the ice tray 110.

Furthermore, the heat insulation member 140 may also surround the heater unit 130. Thus, a portion of the heater unit 130 may be surrounded by the heat insulation member 140 and another portion of the heater unit 130 may be surrounded by the ice tray 110. The heat insulation member 140 may restrain heat transfer to components other than the ice tray 110. For example, the heat insulation member 140 may prevent heat generated by the heater unit 130 from being transferred to an ice storage part 210. Furthermore, the heat insulation member 140 may be located between the heater unit 130 and the cooling pipe 120. The heat insulation member 140 may prevent heat transfer to the cooling pipe 120, thereby preserving cooling efficiency of the cooling pipe 120.

The heat insulation member 140 may be conformal to the contour defined by the ice tray 110, the cooling pipe 120 and the heater unit 130. No gap or a small gap is formed between the heat insulation member 140 and the ice tray 110, between the heat insulation member 140 and the cooling pipe 120, and between the heat insulation member 140 and the heater unit 130. This can reduce the amount of air and thus the air moisture content between the heat insulation member 140 and the ice tray 110, and between the heat insulation member 140 and the cooling pipe 120 and between the heat insulation member 140 and the heater unit 130. As a result, the heat insulation member 140 may prevent frost formation from moisture on the surfaces of the ice tray 110 and the cooling pipe 120. In addition, the heat insulation member 140 may be made of a material having low thermal conductivity. For example, the heat insulation member 140 may be, but is not limited to, a Styrofoam or other suitable material.

The ice-storing unit 200 may include an ice storage part 210, an ice-making device evaporator 220 and an ice discharge part 230.

The ice storage part 210 is configured to receive ice pieces from the ice tray 110 by the operation of the ice-releasing member 112. The ice storage part 210 may receive cold air from the ice-making device evaporator 220. The ice storage part 210 may be, for example, a container with a top opening.

A discharge path 211 may be disposed in the lower portion of the ice storage part 210. Frost may be generated within the ice-storing unit 200 but can be melted to water and remain at the bottom of the ice storage part 210. This water can be discharged from the ice-making device 50 through the discharge path 211. The discharge path 211 may be, but is not limited to, a duct provided in the lower portion of the ice-making device 50.

The ice-making device evaporator 220 may cool the ice-making unit 100 and the ice-storing unit 200. Moreover, the ice-making device evaporator 220 may receive refrigerant from the condenser 40.

The ice-making device evaporator 220 may be coupled to the cooling pipe 120 of the ice-making unit 100. Since the cooling pipe 120 is disposed around the ice tray 110, the ice-making device evaporator 220 may cool the ice tray 110 by the refrigerant flowing through the cooling pipe 120. In other words, the ice-making device evaporator 220 may absorb heat of the ice-making unit 100 via the cooling pipe 120.

The ice-making device evaporator 220 is configured to cool surrounding air. The ice-making device evaporator 220 may receive refrigerant from the condenser 40. The refrigerant absorbs the heat from air around the ice-making device evaporator 220. In other words, the refrigerant delivered from the condenser 40 cools ambient air around the ice-making device evaporator 220 into cold air. The cold air may be circulated through the ice-storing unit 200 by a fan 221 to cool the ice storage part 210. The ice-making device evaporator 220 is separate from the refrigerator room evaporator 21 for cooling the refrigerator room 10.

Refrigerant may flow through the ice-making device evaporator 220 and the refrigerator room evaporator 21 in parallel paths. The ice-making device may receive refrigerant from the condenser 40. Refrigerant supplied from the condenser 40 may absorb the heat of the air existing around the ice-making device evaporator 220 and then may be fed to the cooling pipe 120. However, the present disclosure is not necessarily limited thereto. For example, the refrigerant in the condenser 40 may first pass through the cooling pipe 120 and then may flow into the ice-making device evaporator 220. The ice-making device 50 may include the ice-making device evaporator 220. As another example, the refrigerant in the cooling pipe 120 may be different from the refrigerant in the condenser 40. In this case, refrigerant in the condenser 40 may absorb heat from the refrigerant of the cooling pipe 120 and thereby cool the refrigerant of the cooling pipe 120.

The ice discharge part 230 may discharge ice pieces stored from ice storage part 210. The ice discharge part 230 may include a delivery member 231, a drive device 232 and a breaking member 233. Once the delivery member 231 is rotated by the drive device 232, the ice pieces around the delivery member 231 may be moved toward an outlet and then crushed by the breaking member 233 to smaller pieces for efficient discharge.

The control unit 300 may control the ice-making device evaporator 220 to cool the cooling pipe 120. The control unit 300 may be coupled to a sensing device. The sensing device may sense whether water has been introduced into the ice tray 110. Furthermore, the control unit 300 may control circulation of refrigerant within the cooling pipe 120 by controlling the opening/closing device and the pressurizing device installed in the cooling pipe 120. For example, once the sensing device senses introduction of water, the control unit 300 may open the opening/closing device and may activate the pressurizing device to enable refrigerant circulation through the cooling pipe 120. The control unit 300 may include a microprocessor. The control unit 300 can be implemented in any suitable manner that is well known in the art.

Hereinafter, the operation and effect of the ice-making device 50 and the refrigerator are described. After water is introduced into the ice tray 110 from the outside, water in the ice tray 110 can freeze into ice pieces by the cooling effect from the cooling pipe 120. The cooling pipe 120 may rapidly cool the ice tray 110 as refrigerant flows through. In this approach, various components required for air cooling the ice tray 110 are no longer needed, such as a duct, a fan and the like, thereby advantageously simplifying the structure of the refrigerator 1.

Furthermore, the heat insulation member 140 in the ice-making unit 100 may serve to isolate the ice tray 110 and the cooling pipe 120 from surrounding air, the air typically having a relatively high temperature. Accordingly, the heat insulation member 140 may suppress generation of frost or the like on the ice tray 110 and the cooling pipe 120. In addition, the heat insulation member 140 may enhance the cooling efficiency of the ice-making unit 100.

After water fully freezes into ice pieces in the ice tray 110, ice pieces in the ice tray 110 may be transferred to the ice storage part 210. For releasing the ice pieces, the ice-releasing member 112 and the heater unit 130 may be activated. For example, the heater unit 130 may heat the ice tray 110 prior to releasing the ice pieces. Ice pieces may be melted partially by the heating of the heater unit 130 for easy separation from the ice tray 110. Thereafter, the ice-releasing member 112 is driven to discharge the ice pieces from the ice tray 110 to the outside.

Ice pieces fed to the ice storage part 210 may be kept frozen by the ice-making device evaporator 220. The fan 221 adjacent to the ice-making device evaporator 220 may supply cold air around the ice-making device evaporator 220 to the ice storage part 210. Water may condense on the ice storage part 210 due to cooling by the ice-making device evaporator 220. Such moisture may be discharged out of the ice-making device 50 through the discharge path 211. Ice pieces stored in the ice storage part 210 may be moved the outside by the ice discharge part 230.

To enable the series of processes described above, the control unit 300 may control the operations of the ice-making unit 100 and the ice-storing unit 200. For example, the control unit 300 may control the operations of the ice-releasing member 112 and the ice-making device evaporator 220.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by the claims below, not the detailed description, and it should be construed that all changes and modifications achieved from the meanings and scope of the claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. An ice-making device for a refrigerator, the ice-making device comprising:

an ice tray configured to receive water, wherein the water freezes into ice in the ice tray;

a cooling pipe configured to conduct a refrigerant flow and disposed proximate to the ice tray;

a heat insulation member surrounding the cooling pipe and operable to reduce heat transfer between ambient air and the cooling pipe;

an ice storage part configured to store ice produced in the ice tray;

an ice-making device evaporator configured to cool the ice storage part;

a fan configured to circulate air in the ice storage part; and a discharge path for discharging water produced by water condensation on the ice storage part and adjacent to the ice-making device evaporator, wherein the ice-making device evaporator is separate from a refrigerator room evaporator configured to generate cool air for circulation in a refrigerator storage room, and wherein the discharge path is provided in a bottom portion of the ice-making device and between the fan and the ice storage part.

2. The ice-making device of claim 1, wherein a portion of the cooling pipe directly contacts the ice tray.

3. The ice-making device of claim 1 further comprising:

a heater disposed around the ice tray and configured to heat the ice tray, wherein the heat insulation member surrounds the heater and is operable to reduce heat transfer between the heater and ambient air.

4. The ice-making device of claim 1, further comprising a condenser, and wherein the ice-making device evaporator is configured to receive refrigerant from the condenser.

5. The ice-making device of claim 4, wherein the refrigerant is operable to cool the ice storage part and then flows to the cooling pipe.

6. A refrigerator comprising:

a storage room;

an ice-making device configured to receive water and to produce ice from the water;

an ice-making device evaporator disposed in the ice-making device and configured to supply a refrigerant to the ice-making device for freezing the water into ice; and a refrigerator room evaporator configured to produce cold air for circulation in the storage room, wherein the ice-making device further comprises:

an ice tray configured to receive water, wherein the water freezes into ice in the ice tray;

a cooling pipe configured to conduct a refrigerant flow and disposed proximate to the ice tray;

an ice storage part configured to store ice produced in the ice tray;

an ice-making device evaporator configured to cool the ice storage part; and a fan configured to circulate air in the ice storage part, wherein the ice-making device evaporator is separate from a refrigerator room evaporator configured to generate cool air for circulation in a refrigerator storage room, wherein the ice-making device comprises a discharge path for discharging water condensation in the ice storage part and the ice-making device evaporator, and wherein the discharge path is provided in a bottom portion of the ice-making device and between the fan and the ice storage part.

7. The refrigerator of claim 6 further comprising:

a compressor configured to compress a refrigerant supplied from at least one of the refrigerator room evaporator and the ice-making device evaporator; and a condenser configured to dissipate heat while liquefying at least a part of compressed refrigerant.

8. The refrigerator of claim 7, wherein a portion of the cooling pipe directly contacts the ice tray.

9. The refrigerator of claim 8, wherein the ice-making device further comprises a heat insulation member surrounding the cooling pipe and operable to restrict the cooling pipe from exchanging heat with ambient air.

* * * * *